US008449291B2

(12) United States Patent
Tsai

(10) Patent No.: US 8,449,291 B2
(45) Date of Patent: May 28, 2013

(54) GAS COMBUSTOR AND SAFETY ACTUATING DEVICE THEREOF

(76) Inventor: Chih-Lin Tsai, New Taipei (TW)

( * ) Notice: Subject to any disclaimer, the term of this patent is extended or adjusted under 35 U.S.C. 154(b) by 159 days.

(21) Appl. No.: 13/187,104

(22) Filed: Jul. 20, 2011

(65) Prior Publication Data

US 2012/0244480 A1 Sep. 27, 2012

(30) Foreign Application Priority Data

Mar. 23, 2011 (TW) ..... 100205139 U

(51) Int. Cl.
*F23D 14/72* (2006.01)

(52) U.S. Cl.
USPC ..... 431/153; 431/255; 431/344

(58) Field of Classification Search
USPC ..... 431/153, 254, 255, 256, 277, 344, 431/354
See application file for complete search history.

(56) References Cited

U.S. PATENT DOCUMENTS 5,466,149 A * 11/1995 Tsai ..... 431/344
6,293,782 B1 * 9/2001 Tsai ..... 431/153
7,527,496 B2 * 5/2009 Lin ..... 431/344
7,850,446 B2 * 12/2010 Tsai ..... 431/255

* cited by examiner

*Primary Examiner* — Alfred Basichas
(74) *Attorney, Agent, or Firm* — Guice Patents PLLC

(57) ABSTRACT

The present invention relates to a gas combustor, which comprises a storage tank, a connect seat allowing an ignition device and a combustion device to be installed, and a housing. The rear of the connection seat is formed with an accommodation slot in sequence allowing a piezoelectric device of the ignition device and a pressable button member to be installed and positioned, the front of the button member is protruded with a push sheet. Two clamp arms at the front of the connection seat define an insertion slot allowing an insertion tenon fixed at the rear of a mixing tube of the combustion device to be inserted and positioned, such that the mixing tube and the piezoelectric device are in contact. The mixing tube is formed with at least an air inlet hole, and the front and the rear thereof are respectively installed with an ejection nozzle connected to one end of a gas conveying tube and a flame nozzle, and an electric conduction wire of the piezoelectric device is arranged at the periphery of the flame nozzle at intervals. Through pressing the button member, the gas discharge nozzle of the storage tank is enabled to supply combustion gas, and the electric conduction wire at the lateral side of the flame nozzle generates static electric sparks for igniting the mixed combustion gas ejected from the flame nozzle.

13 Claims, 9 Drawing Sheets

GAS COMBUSTOR AND SAFETY ACTUATING DEVICE THEREOF

BACKGROUND OF THE INVENTION

1. Field of the Invention

The present invention relates to a gas combustor, especially to a gas combustor having a rapid assembly function through a modularization design. The present invention further provides a safety actuating device used in a gas combustor.

2. Description of Related Art

Fire is a must-have matter in human being's daily life, with fire we can cook food, have lights, even operating casting, melting or welding metals. A gas combustor, e.g. a refillable lighter or portable gas stove, consumes liquid gas for igniting objects or cooking foods. Even at present, the gas combustor still plays an irreplaceable role.

The Taiwan Utility Patent No. M338954 (corresponding to the U.S. Pat. No. 7,850,446) granted to the applicant of the present invention has disclosed a hand-held gas combustion apparatus which comprises a storage tank, a gas discharge device, a housing, an ignition device, a safety actuating device and a flame device. The housing is installed on top of the storage tank, and positioning members e.g. plural accommodating slots, preset inside the housing are respectively provided for the installation of a piezoelectric device of the ignition device and a recovery member, e.g. a spring. In use, a user has to firstly release the locking state of the safety actuating device below a button member then proceeds to the operation of pressing the button member. During pressing the button member, the piezoelectric device and the recovery member are respectively compressed, so static electric sparks are generated near a flame nozzle of the flame device for igniting the mixed combustion gas ejected from the flame nozzle, and a gas discharging board is pushed by a push rod preset on the button member, such that a gas discharge nozzle of the storage tank is lifted for forming a gas supply state, and the combustion gas is conveyed to the flame device through a gas conveying tube, and mixed with air in a mixing tube then ejected from the flame nozzle.

In view of what is mentioned above, the housing is a necessary component for fixing the ignition device, the safety actuating device and the flame device. However, when the dimension or shape of the housing is charged, the relative locations of the positioning members installed inside have to be rearranged, and the difficulty during designing is therefore caused. As such, how to modularize the ignition device and the flame device of a gas combustor is an issue which shall be concerned by skilled people in the arts.

Moreover, for a conventional safety actuating device used in a gas combustor, for example the safety actuating device of a gas combustor disclosed in the Taiwan Utility Patent No. M446104 (corresponding to the U.S. Pat. No. 6,293,782) granted to the applicant of the present invention comprises a fasten member, a press member and a slide member, wherein the press member is moveably and longitudinally sleeved on one end of the fasten member, and the slide member is moveably and transversally installed on the other end of the fasten member, and an interfere state is formed between adjacent portions of the press member and the slide member. For preventing the slide member from longitudinally releasing from the fasten member, elongated engaging slots formed on the slide member are installed in positioning pins preset on the fasten member, then screws are utilized to be fitted at the positioning pins, so the slide member is prevented from releasing from the fasten member. Because the safety actuating device is very small in volume, the screw fitting operation not only increases the assembly procedure but also consumes more labor force.

SUMMARY OF THE INVENTION

One primary object of the present invention is to provide a gas combustor, wherein an ignition device and a combustion device being modularized and having a rapid assembly function and capable of being further installed with a safety actuating device, and overcoming the shortage of custom fabricating positioning members on the inner wall of a housing for each device.

For achieving the mentioned object, one solution provided by the present invention is to provide a gas combustor, which comprises:

a storage tank, having a gas discharge nozzle on the top of a tank body, the gas discharge nozzle is connected to one end of a gas conveying tube, and further installed with a gas discharging board;

a connection seat, having an accommodation slot at the rear, the accommodation slot in sequence accommodates and positions a piezoelectric device of the ignition device and a pressable button member, the front of the button member is extended with a push sheet adjacent to the gas discharging board; two clamp arms at the front of the connection seat define an insertion slot which allows an insertion tenon fixed at the rear of a mixing tube of the combustion device to be inserted and positioned, so the mixing tube is in contact with the piezoelectric device, the mixing tube is formed with at least an air inlet hole, and the front and the rear are respectively installed with an ejection nozzle connected to the other end of the gas conveying tube and a flame nozzle, an electric conduction wire of the piezoelectric device is arranged at the periphery of the flame nozzle at intervals; and a housing, composed of a left cover and a right cover being engaged, for accommodating the mentioned storage tank, the connection seat, the ignition device and the combustion device, the front and the rear openings of a control part horizontally installed on the top of the housing respectively allow the flame nozzle and the button member to be exposed, adjacent surfaces of the housing and the connection seat are oppositely installed with positioning members, so the connected seat is fastened inside the housing;

through pressing the button member, the piezoelectric device is compressed, and the push sheet pushes the gas discharging board for lifting the gas discharge nozzle so as to supply combustion gas, so the combustion gas is conveyed by the gas conveying tube to the ejection nozzle for being ejected and mixed with air in the mixing tube, and the electric conduction wire at the lateral side of the flame nozzle generates static electric sparks for igniting the mixed combustion gas ejected from the flame nozzle.

Another object of the present invention is to provide a safety device used in a gas customer, with designs for simplifying components, the complicated fixing and fastening procedure is avoided and the labor force is effectively saved.

For achieving the mentioned object, one solution provided by the present invention is to provide a safety actuating device used in a gas combustor, which comprise:

a fasten member, having a chamber at the top, the rear of the chamber is in communication with a guide slot longitudinally installed, and the left and the right sides at the front are formed with a pair of rail slots, wherein the horizontal bottom wall at the front of the chamber is concavely formed with a concave slot in which a horizontal resilient member is installed, and the vertical bottom wall at the rear of the chamber is installed with a vertical resilient member;

a press member, the rear thereof is longitudinally installed with a press piece, a neck part at the front of the press piece is inserted in the guide slot, and the front of the neck part is longitudinally and protrudingly installed with a block, the left and the right sides of the block are oppositely and protrudingly formed with a pair of engaging tenons, and the notch of each engaging tenon forms an engaging slot; and a slide member, slide rails at the left and the right sides thereof are inserted into the pair of rail slots, the bottom of the slide member is protrudingly installed with a push tenon which incorporates with the concave slot to hold the horizontal resilient member, the left and the right sides at the rear of the slide member are protrudingly installed with a pair of joint tenons, a tenon slot is formed between the two joint tenons for accommodating the block;

through downwardly pulling the press piece, the block is synchronously descended, and the joint tenons of the slide member are no longer provided with the support of the engaging slots of the engaging tenons thereby being backwardly moved, such that the joint tenons are jointed at the top of the engaging tenons; when the joint tenons are pushed forward by an external force, the press member is upwardly moved, and the engaging slots are engaged with the bottom of the joint tenons, such that the slide member and the press member form an automatic latch locking state.

DETAILED DESCRIPTION OF THE PREFERRED EMBODIMENT

Figure 1:
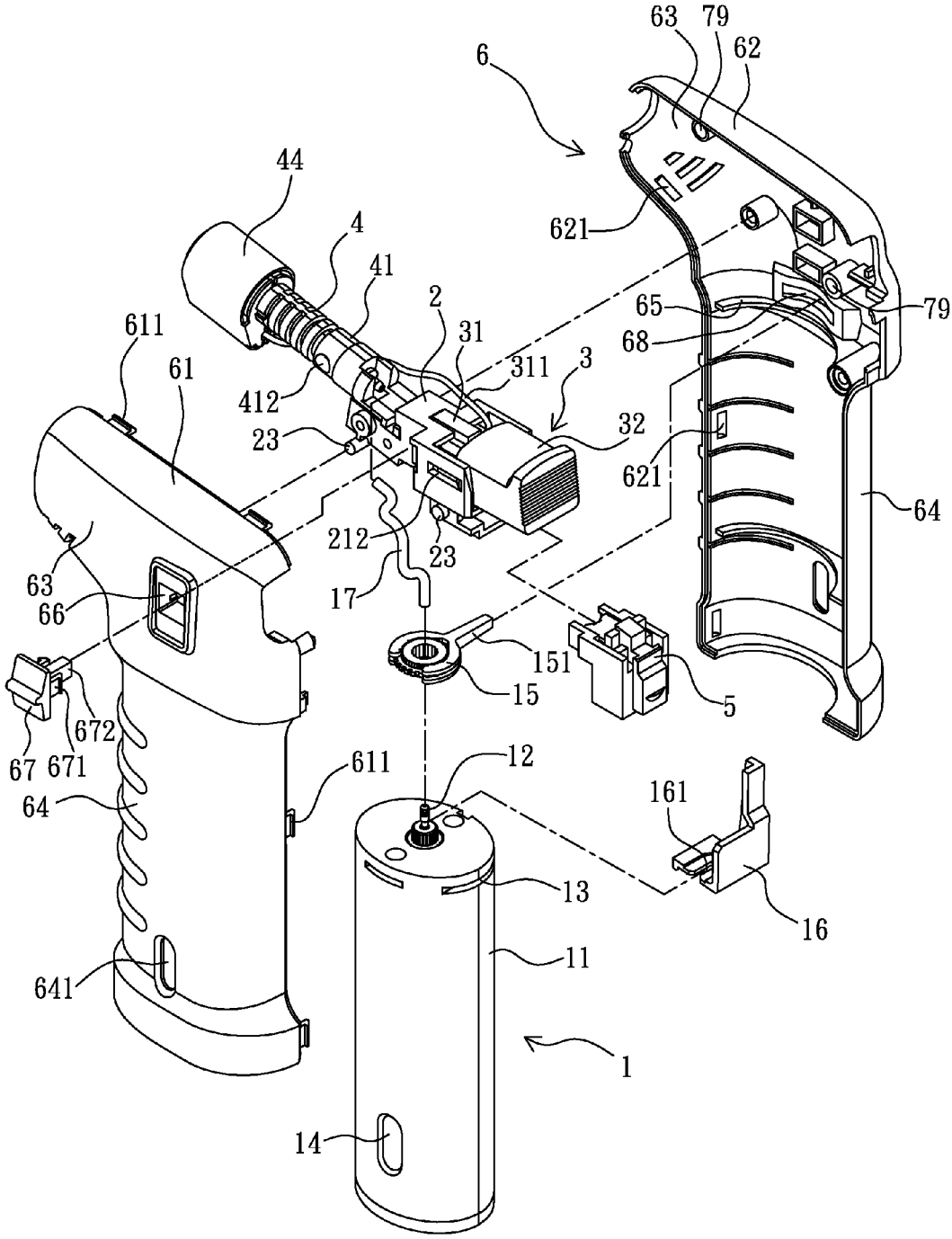
FIG. 1 is an exploded perspective view illustrating the gas combustor according to the present invention.
Figure 2:
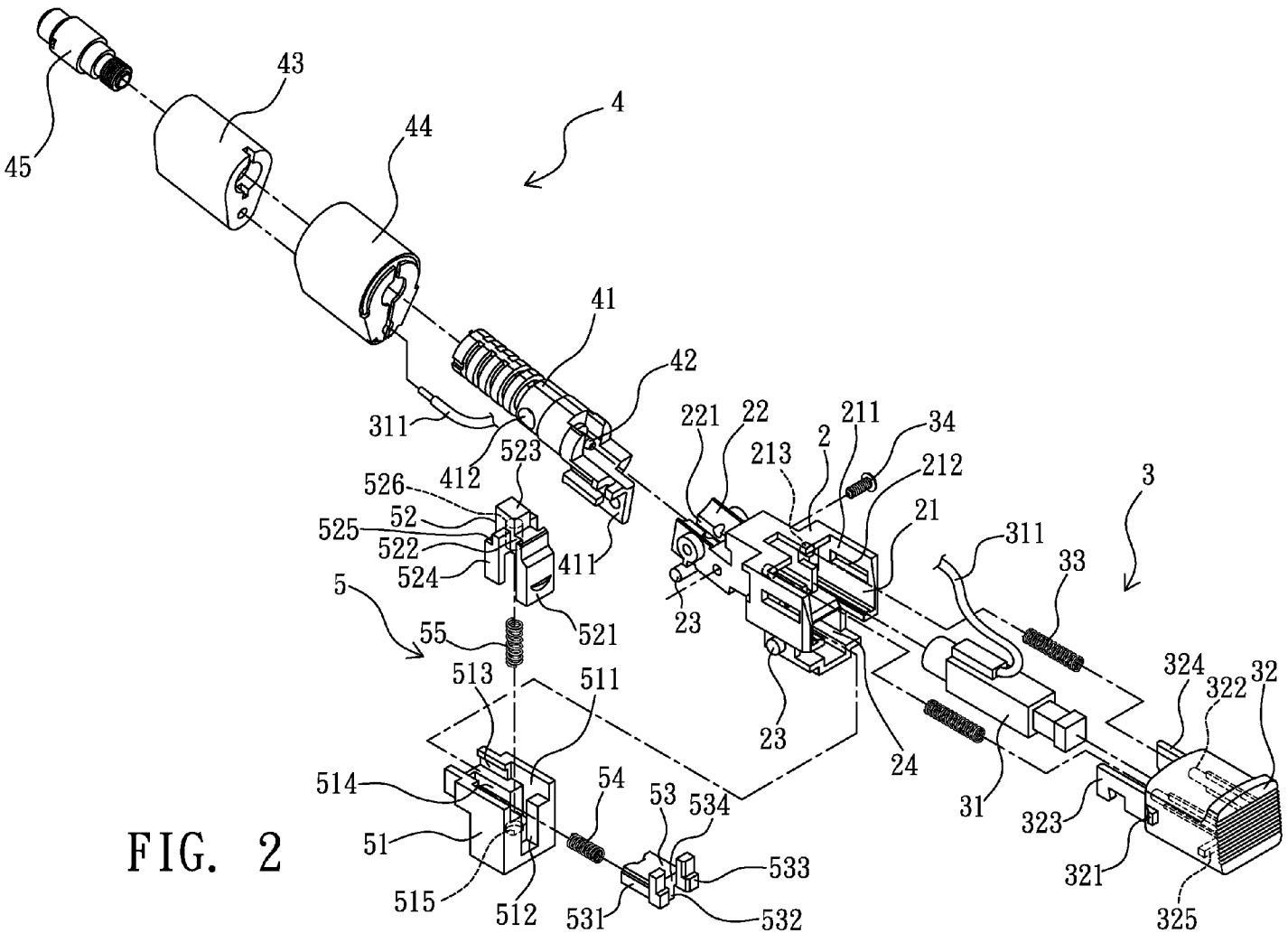
FIG. 2 is an exploded perspective view illustrating the connection seat, the ignition device, the combustion device and the safety actuating device, according to the present invention.

As shown in FIG. 1 and FIG. 2, the gas combustor provided by the present invention substantially comprises a storage tank 1, a connection seat 2, an ignition device 3, a combustion device 4, a safety actuating device 5 and a housing 6.

The storage tank 1 is a container for storing liquid gas, and the bottom and the top of a tank body 11 thereof are respectively installed with a conventional filling nozzle (not shown in figures) and a gas discharge nozzle 12. Moreover, the periphery of the upper portion of the tank body 11 is installed with a positioning slot 13, and the lower portion of the tank body 11 is installed with at least an elongated viewing window 14, e.g. a pair of viewing windows 14 symmetrically installed, for conveniently observing the residual amount of the liquid gas in the storage tank 1.

The gas discharge nozzle 12 is sleeved with a gas regulation ring 15, and a regulation rod 151 laterally extended from the gas regulation ring 15 protrudes from a preset elongated cover slot 68 of the housing 6, and a L-shaped gas discharging board 16 is installed on the gas regulation ring 15. The gas discharging board 16 utilizes a mount slot 161 to be sleeved with the gas discharge nozzle 12. The torque generated while the gas discharging board 16 being pushed forward by a push sheet 324 of a button member 32 enables the gas discharging board 16 to upwardly raise with its front end serving as the pivot, such that the gas discharge nozzle 12 is lifted through the mount slot 161 for forming a combustion gas supply state. The gas discharge nozzle 12 is further sleeved with a gas conveying tube 17, so when the gas discharge nozzle 12 is lifted and the liquid gas in the storage tank 1 is evaporated, the evaporated gas is introduced into the gas conveying tube 17 from the gas discharge nozzle 12, then rapidly ejected by an ejection nozzle 42 fixed at the rear of the combustion device 4, so as to be transported into a mixing tube 41.

The connection seat 2 is a hollow seat member, and the rear thereof is formed with an accommodation slot 21 for in sequence being installed and positioned with a piezoelectric device 31 and the button member 32 of the ignition device 3. The left and right lateral walls 211 of the accommodation slot 21 are respectively formed with an elongated slide rail 212, and the button member 32 is protrudingly installed with block-shaped slide tenons 321 corresponding to the pair of slide rails 212, wherein the pair of slide tenons 321 are installed in the slide rails 212 in a slidable fashion. For providing an auxiliary recovery mechanism to the button member 32, opposite inner walls of the button member 32 and the accommodation slot 21 are installed with at least a recovery resilient member 33, e.g. a spring; the positioning means of each recovery resilient member 33 is carried out through installing spring tenons 213, 322 on the opposite inner walls of the mentioned two components for allowing two ends of the spring 33 to be received.

As such, when the button member 32 is pressed, the self elastic force of the piezoelectric device 31 can be provided for automatically recovering the button member 32, and with the elastic force of the recovery resilient member 33, the button member 32 can be rapidly recovered to a non-pressed state. The left and right sides of the button member 32 are respectively extended with a buckling sheet 323 and a push sheet 324, for being buckled with a continuous gas supply switch 67 and for pushing the rear top end of the mentioned gas discharging board 16.

Moreover, the bottom of the button member 32 is protrudingly installed with a button protrusion 325, when the locking state of the safety actuating device 5 is not released, the button protrusion 325 is abutted against the safety actuating device 5, so operations of gas supply and ignition can not be performed through pressing. The left and right lateral walls of the connection seat are protrudingly installed with at least a convex tenon 23 for being inserted in inner walls of the housing 6 for positioning.

Two clamp arms 22 at the front of the connection seat 2 define an insertion slot 221, e.g. a cross-shaped insertion slot 221, which allows an insertion tenon 441 having the shape and formed at the rear of the mixing tube 41 of the combustion device 4 to be inserted, then a connection member 34, e.g. a screw, insertion pin or rivet, is utilized to pass through holes preset on the clamp arms 22 and the insertion tenon 411 for being integrated as one piece, such that the combustion device 4 is fixed at the front of the connection seat 2. The mixing tube 41 is made of a metal material, and the insertion slot 221 is in communication with the accommodation slot 21, so the insertion tenon 411 of the mixing tube 41 is in contact with the piezoelectric device 31, and an electric conduction wire 311 of the piezoelectric device 31 forms a current loop, so there is no need to additionally install a return circuit between a flame nozzle 45 and the piezoelectric device 31.

The combustion device 4 has the mentioned mixing tube 41, and the rear thereof is fixed in the connection seat 2, the rear of the mixing tube 41 is installed with the mentioned ejection nozzle 42. The ejection nozzle 42 is connected to the gas conveying tube 17, so with the air flow formed through ejecting the combustion gas into the mixing tube 41, air is enabled to be introduced from an air inlet hole 412 preset on the mixing tube 41 for entering the mixing tube 41 for a purpose of mixing. The mentioned flame nozzle 45 is sleeved in a heat insulation member 43 made of a ceramic material, and connected to the front of the mixing tube 41, so the mixed combustion gas is ejected from the flame nozzle 45. The exterior of the heat insulation member 43 is installed with an outer shell 44 made of a metal material for protecting the heat insulation member 43, and the mentioned electric conduction wire 311 passes through the outer shell 44 and the heat insulation member 43, and the exposed metal end of the electric conduction wire 311 is installed at the periphery of the flame nozzle 45 at intervals, such that the generated static electric sparks can ignite the mixed combustion gas ejected from the flame nozzle 45.

The safety actuating device 5 consists of a fasten member 51, a press member 52 and a slide member 53. The safety actuating device 5 is installed in the embedding slot 24 at the bottom of the accommodation slot 21.

The fasten member 51 is reversed L-shaped hollow seat member, and the top thereof has a chamber 511 also in a reversed L-shape. The rear of the chamber 511 is in communication with a guide slot 512 which is longitudinally formed, so after being combined with the press member 52, the press member 52 is enabled to longitudinally move. The left and right sides at the front of the chamber 511 are installed with a pair of rail slots 513 for receiving the slide member 53 and allowing the slide member 53 to slide. The horizontal bottom wall at the front of the chamber 511 is concavely installed with a concave slot 514 in which a horizontal resilient member 54, e.g. a spring, is installed, the vertical bottom wall at the rear of the chamber 511 is installed with a concave hole 515 for receiving a vertical resilient member 55, e.g. a spring. A protrusion part having a convex/concave shape at the front of the fasten member 51 is directly inserted in the embedding slot 24 for positioning.

The rear of the press member 52 is longitudinally installed with a press piece 521, through a neck part 522 at the front being inserted in the guide slot 512, the press piece 521 is exposed outside the fasten member 51. The front of the neck part 522 is longitudinally and protrudingly installed with a block 523. The left and right sides of the block 523 are oppositely and protrudingly installed with a pair of engaging tenons 524, the notch of each engaging tenon 524 forms an engaging slot 525 for forming an interfere or release state with the slide member 53. Moreover, the bottom of the block 523 is formed with an engaging hole 526 and sleeved with the mentioned vertical resilient member 55, e.g. a spring, such that the press member 52 is enabled to vertically and elastically move in the guide slot 512.

The slide member 53 is a sheet member, the slide rails 531 at the left and right sides are inserted in the rail slots 513 of the fasten member 51 for preventing from longitudinally releasing from the fasten member 51. The bottom of the slide member 53 is protrudingly installed with a push tenon 532 which incorporates with the concave slot 514 to hold the horizontal resilient member 54. Moreover, the left and right sides at the rear of the slide member 53 are protrudingly installed with a pair of joint tenons 533, wherein a tenon slot 534 is formed between the two joint tenons 533 for accommodating the block 523.

The housing 6 is composed of a left cover 61 and a right cover 62 being engaged with each other, e.g. engaging surfaces of the above two are correspondingly installed with plural pairs of buckling hooks 611 and buckling slots 621 being buckled with each other, such that an accommodation space formed inside the housing 6 can accommodate the mentioned storage tank 1, the connection seat 2, the ignition device 3, the combustion device 4 and the safety actuating device 5. The front and rear openings of a control part 63 horizontally installed on the housing 6 are respectively serve to allow the outer shell 44, the button member 32 and the press member 52 to be exposed. The bottom opening of a vertical handgrip part 64 installed on the housing 6 is served to support the bottom of the tank body 11. The vertical handgrip part 64 of the housing 6 is installed with window openings 641 corresponding to the location of the viewing windows 14 of the storage tank 1, for observing the residual amount of the liquid gas inside the storage tank 1. Moreover, a positioning rib 65 is installed between inner walls of the control part 63 and the handgrip part 64 for being inserted in the positioning slot 13 of the storage tank 1, therefore the storage tank 1 can be firmly fastened inside the handgrip part 64.

Moreover, for providing a continuous combustion function, a housing slot 66 formed at the left cover 61 is installed with the mentioned continuous gas supply switch 67. The front and rear of the switch 67 are protrudingly installed with at least a pair of slide hooks 671 buckled in the housing slot 66, such that the switch 67 is enabled to longitudinally slide in the housing slot 66, and a buckling rod 672 is protruded between the two slide hooks 671. When the button member 32 is in a pressed state, a user upwardly lift the continuous gas supply switch 67, so the buckling rod 672 is buckled in a buckling hole preset on the buckling sheet 323 and the button member 32 is not able to be backwardly moved for recovery, and the push sheet 324 continuously abuts against the gas discharging board 16, so a continuous gas supply state is formed. Moreover, the right cover 62 is transversally installed with an elongated cover slot 68 corresponding to the location of the regulation rod 151 of the gas regulation ring 15; when the regulation rod 151 is operated, the gas discharge nozzle 12 rotates with the gas regulation ring 15 for regulating the discharge amount of the combustion gas.

Moreover, adjacent surfaces of the control part 63 of the housing 6 and the connection seat 2 are oppositely installed with positioning members, e.g. convex tenons 23 and insertion holes 79, such that the connection seat 2 can be rapidly fastened inside the housing 6.

Figure 3A:
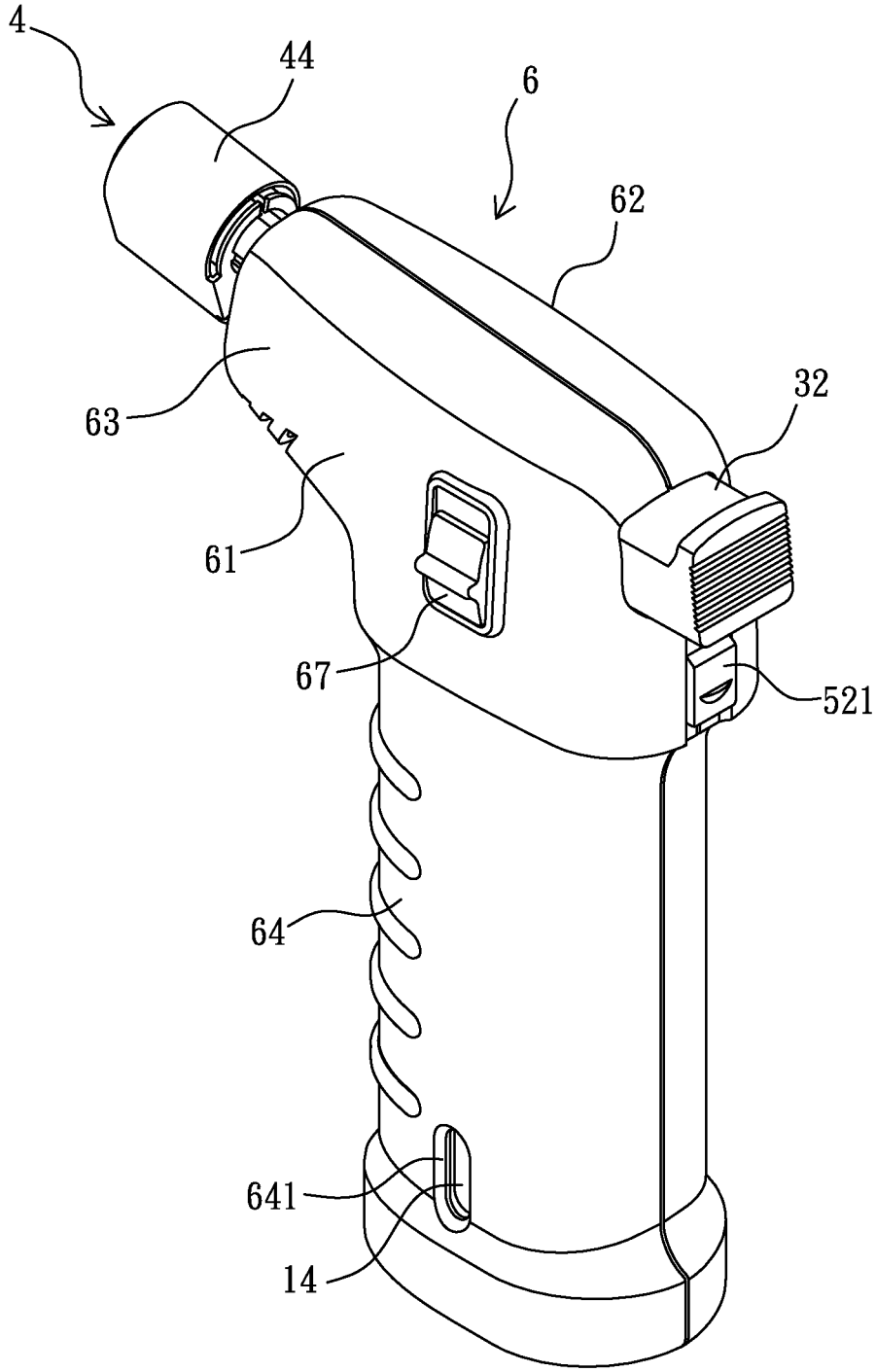
FIG. 3*a* and FIG. 3*b* are schematic perspective views illustrating the assembly of the present invention while being taken from two different viewing angles.
Figure 3B:
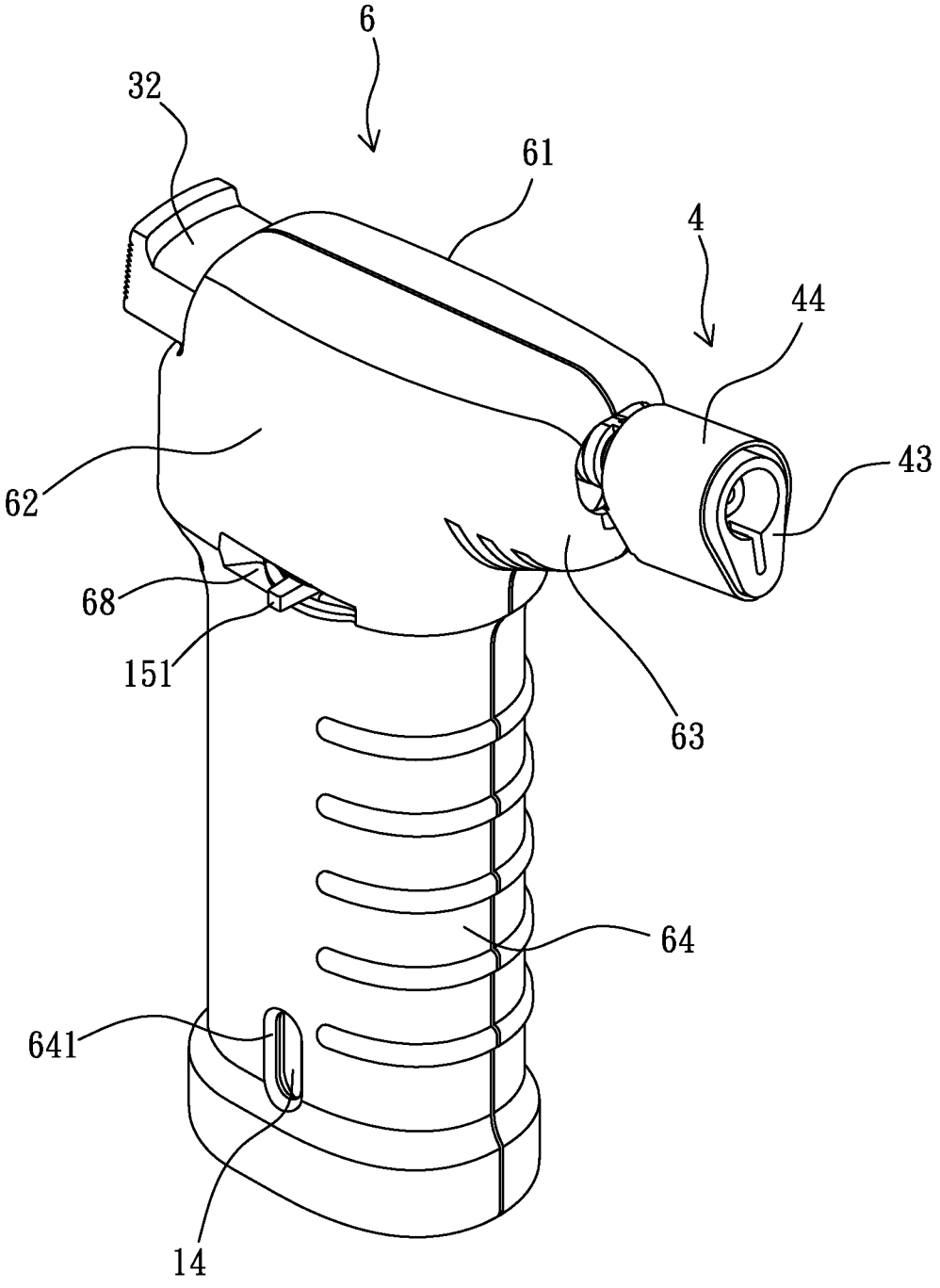
Figure 4:
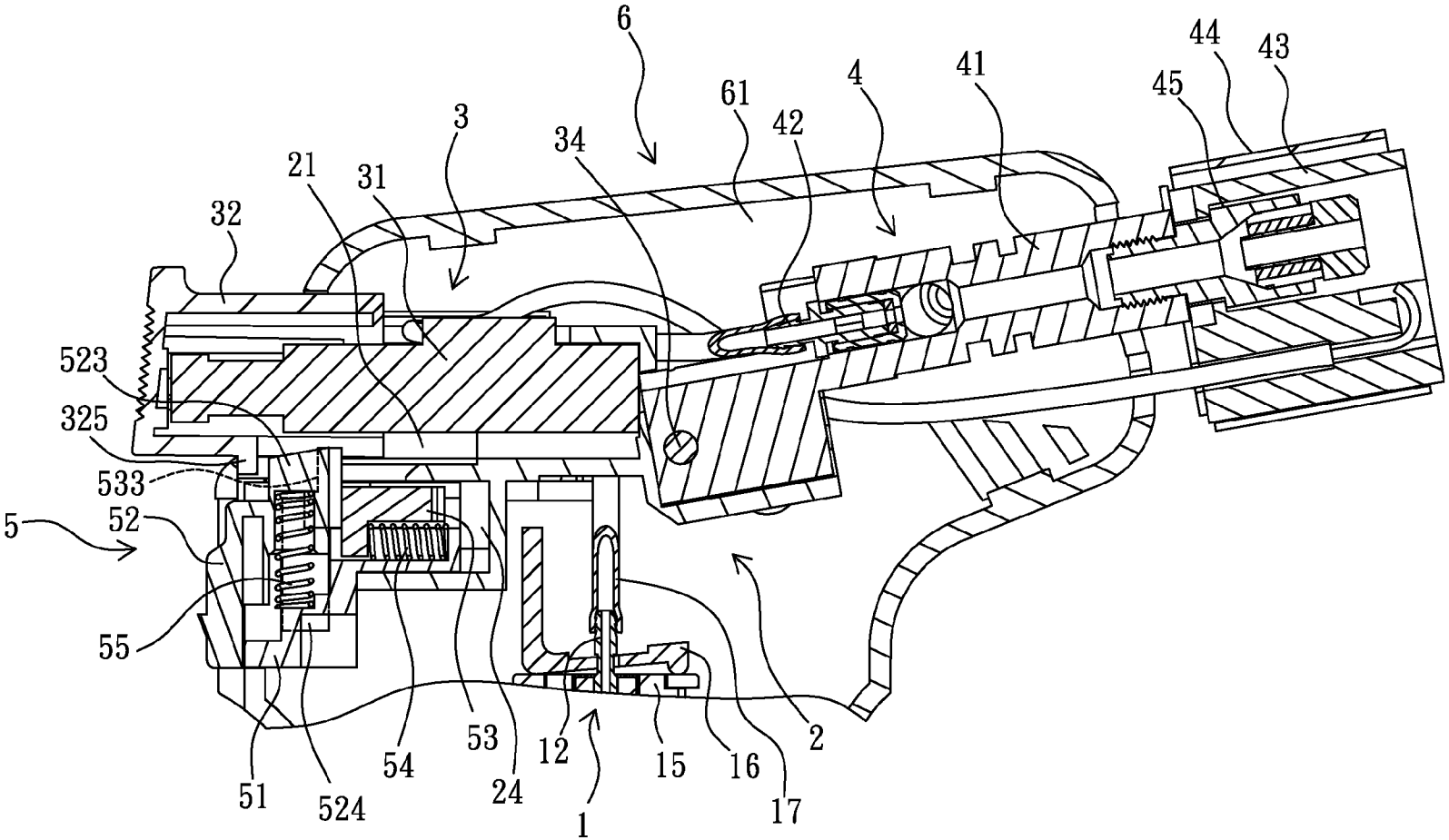
FIG. 4 is a cross sectional view illustrating the non-operation state according to the present invention.

Referring to FIG. 3*a* and FIG. 3*b*, which are schematic perspective views showing the gas combustor according to the present invention, while being taken at two different viewing angles. As shown in FIG. 4, the safety actuating device 5 is in a locking state, so the joint tenons 533 of the slide member 53 are abutted against the engaging tenons 524, and jointed and accommodated above the engaging slots 525, so the button protrusion 325 at the bottom of the button member 32 is restrained by the block 523 and not able to be forwardly pressed. As such, the gas discharge nozzle 12 and the ignition device 3 can not be synchronously operated.

Figure 5:
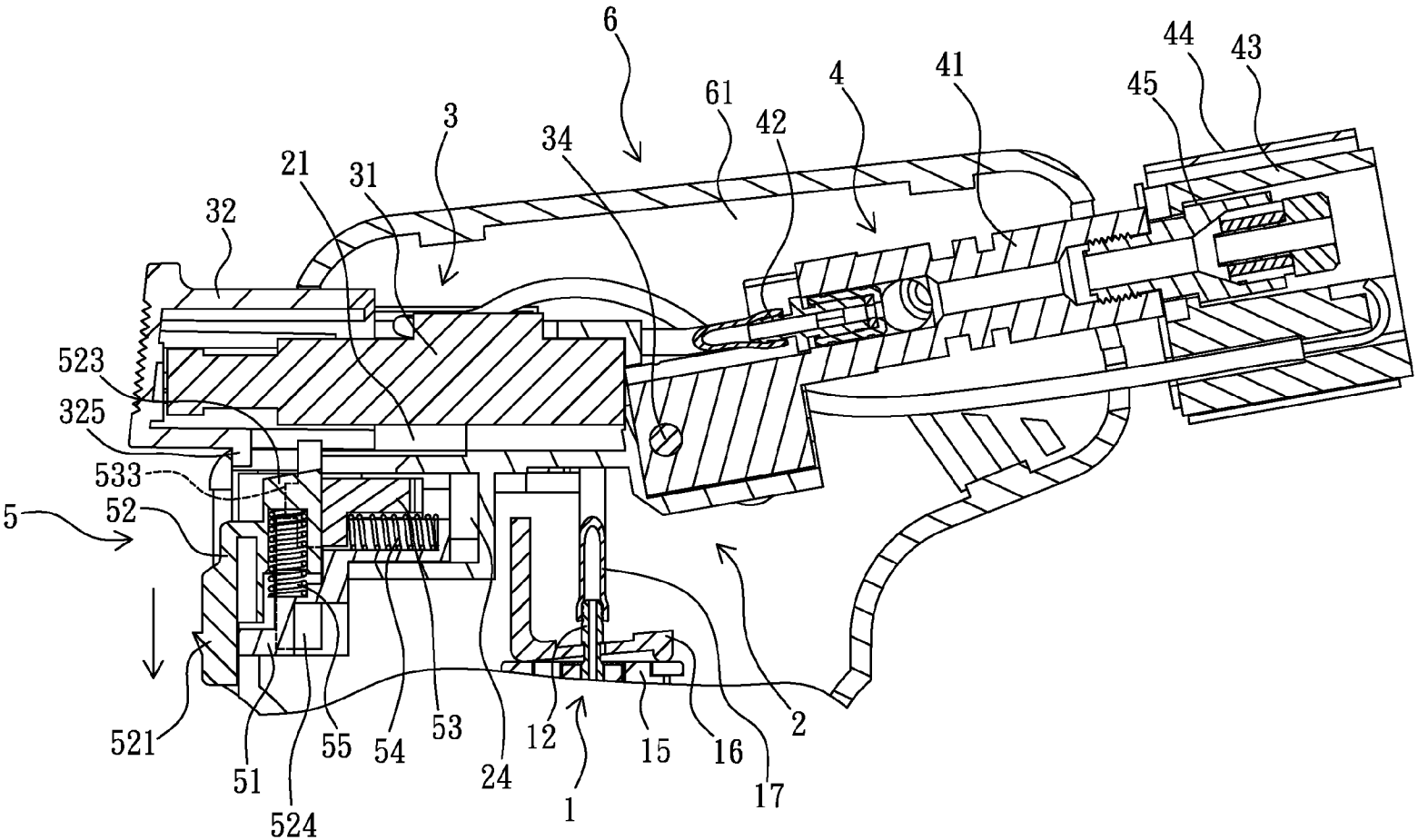
FIG. 5 is a cross sectional view illustrating the safety actuating device being in an unlocking state, according to the present invention.

As shown in FIG. 2 and FIG. 5 to FIG. 7, when a user downwardly pull the press piece 521 of the press member 52, and the vertical resilient member 55 below the press piece 521 is compressed at the same time, so the engaging tenons 524 are downwardly moved; and the joint tenons 533 of the slide member 53 are no longer supported by the engaging slots 525 of the engaging tenons 524, thereby backwardly moved through the stretch of the horizontal resilient member 54, so the joint tenons 533 are jointed to the top of the engaging tenons 524, and the press member 52 and the block 523 are together downwardly moved, for forming the unlocking state shown in FIG. 5.

Figure 6:
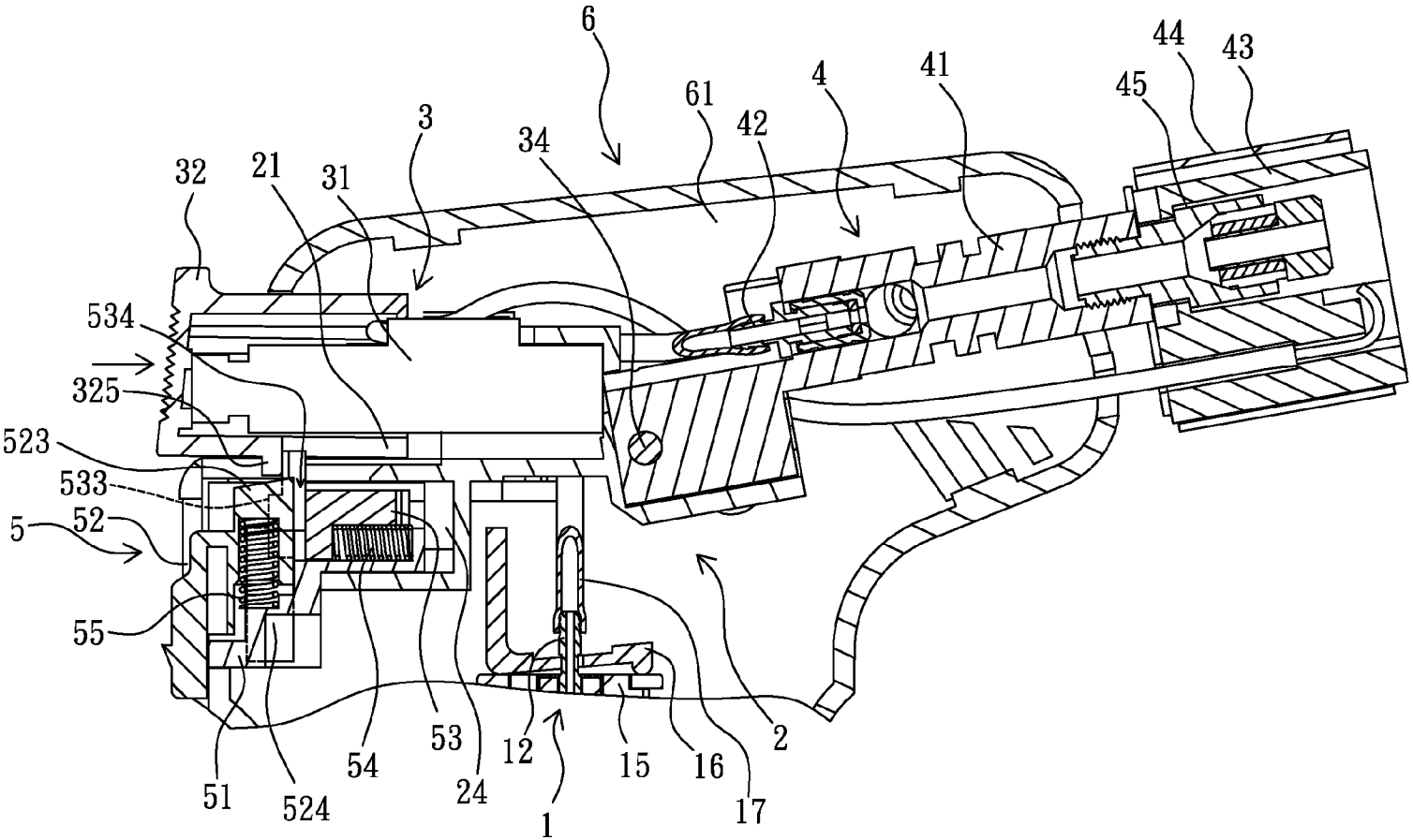
FIG. 6 is a cross sectional view illustrating the operations of gas supply and ignition being synchronously operated, according to the present invention.
Figure 7:
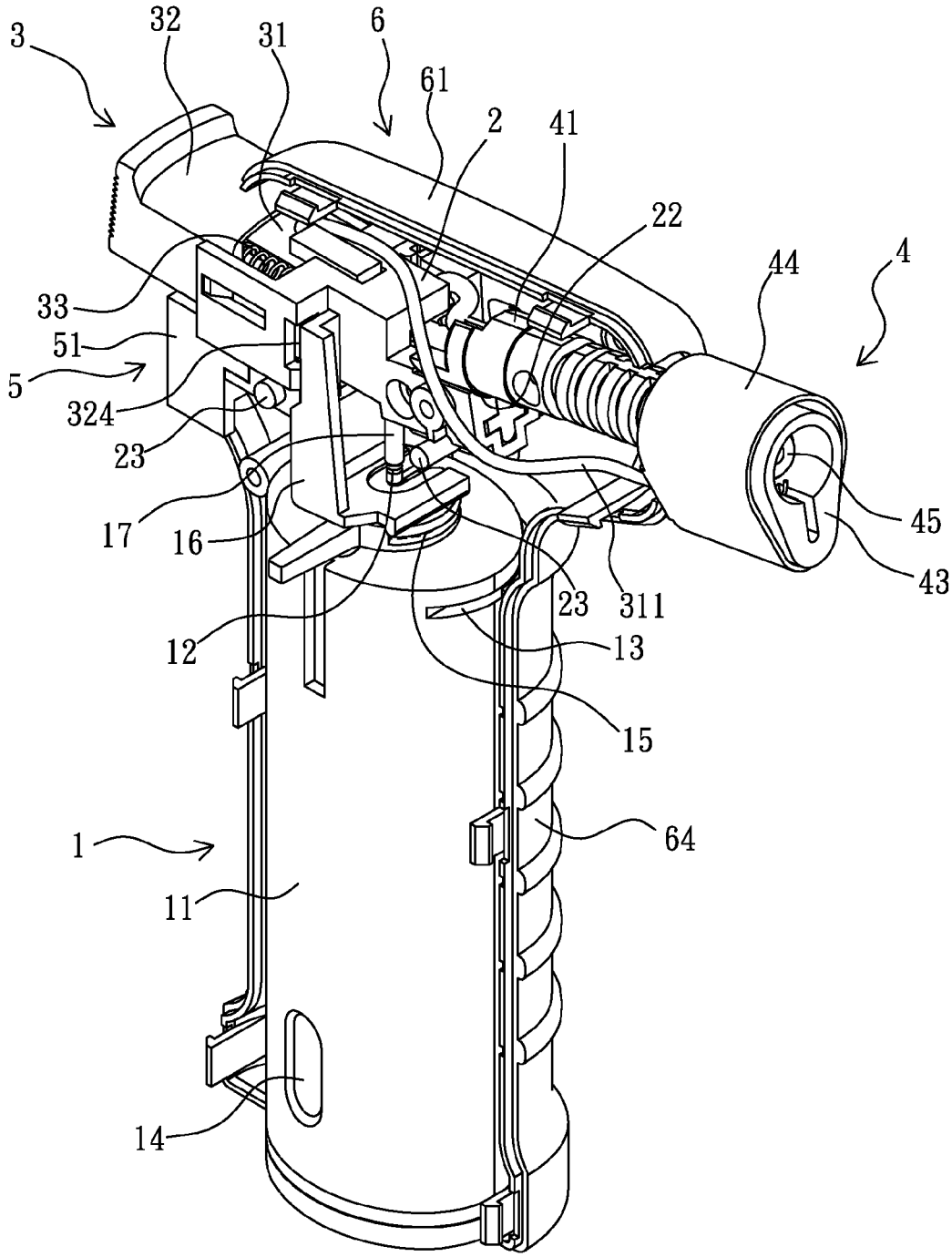
FIG. 7 is a schematic view illustrating the button member pushing the gas discharging suppressing board for forming a gas supply state, according to the present invention.

As shown in FIG. 6, at this moment, the user can press the button member 32, and the button protrusion 325 passes through the tenon slot 534 of the slide member 53 and presses the piezoelectric device 31; as shown in FIG. 7, the rear top end of the gas discharging board 16 is pushed during the forward movement of the push sheet 324 of the button member 32, such that the gas discharging board 116 is upwardly raised with its front end serving as the pivot for lifting the gas discharge nozzle 12; after the liquid gas in the storage tank 1 is evaporated, the evaporated gas is introduced into the gas conveying tube 17 from the gas discharge nozzle 12 and rapidly ejected out through the ejection nozzle 42 fixed at the rear of the combustion device 4 so as to enter the mixing tube 41. The electric conduction wire 311 at the lateral side of the flame nozzle 45 generates the static electric sparks for igniting the mixed combustion gas, thus the combustion operation is processed.

During pressing the mentioned button member 32, the bottom edge thereof is in contact and pushes the two joint tenons 533, so the slide member 53 is moved to compress the horizontal resilient member 54, the press member 52 is therefore no longer provided with the latch effect and upwardly moved through the elasticity of the vertical resilient member 55, but the press member 52 is restrained by the bottom edge of the button member 32 and not able to be recovered. The button member 32 is released and recovered through the elastic forces of the piezoelectric device 31 and the recovery resilient member 33; at this moment, the press member 52 is no longer provided with the interfere effect so as to be recovered to its original location, and forms an automatic latch locking state with the slide member 53, and the supply of combustion gas is stopped due to the recovery of the gas discharging board 16, so the flame of the combustion device 4 is extinguished.

Figure 8:
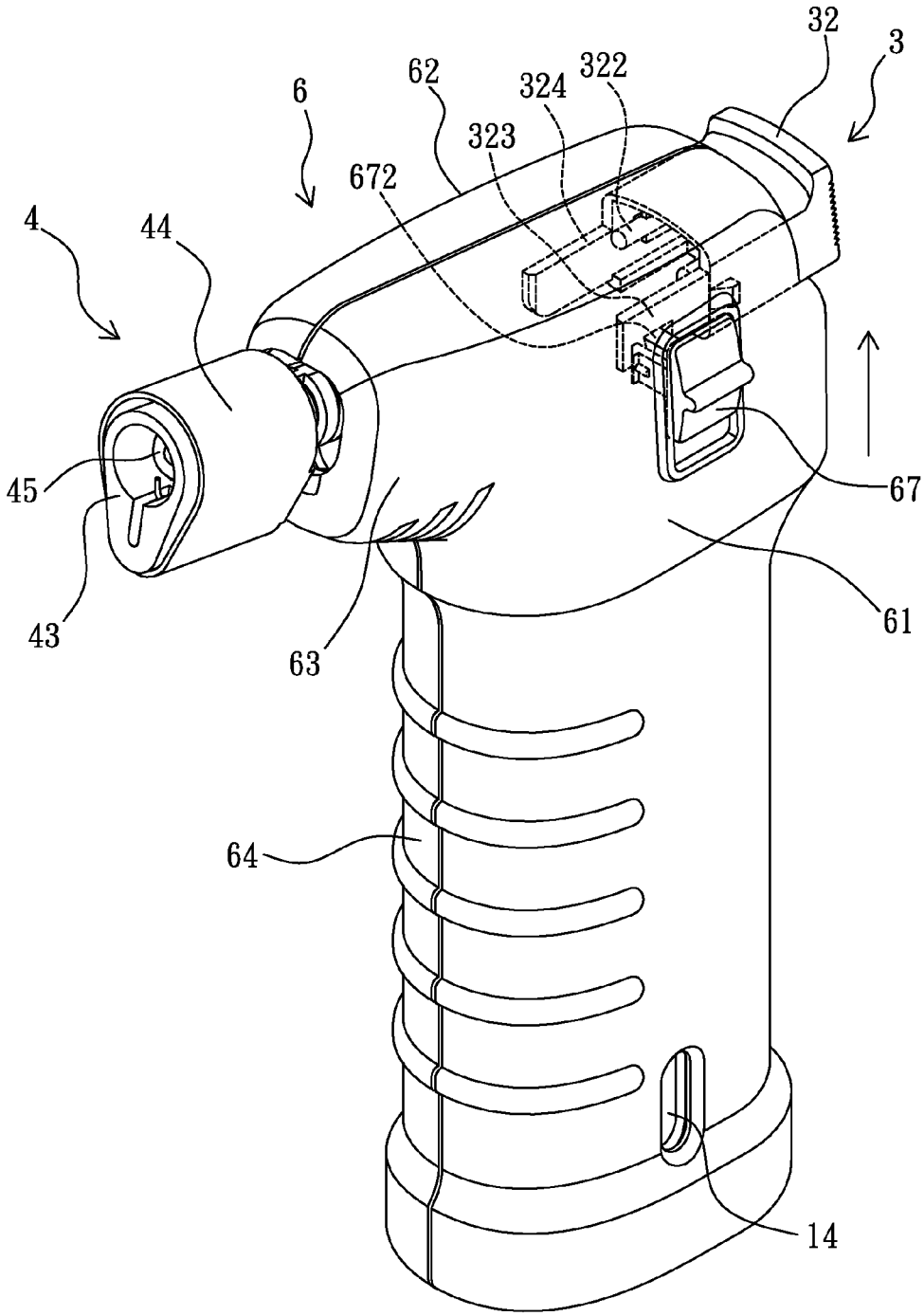
FIG. 8 is a schematic view illustrating the continuous gas supply state, according to the present invention.

As shown in FIG. 8, if the combustion operation is desired to be continued, the user only has to upwardly lift the continuous gas supply switch 67, and the buckling rod 672 is buckled in the buckling hole preset on the buckling sheet 323, such that the button member 32 can not be backwardly moved for recovery, and the push sheet 324 continuously abuts against the gas discharging board 16, a continuous gas supply state is therefore formed.

According to what is mentioned above, the present invention has following advantages: through modularizing the connection seat, the ignition device and the combustion device can be rapidly installed at the front and the rear of the connection seat; because the mixing tube of the combustion device and the piezoelectric device of the ignition device are in direct contact, there is no need to additionally install a return circuit between the flame nozzle and the piezoelectric device; the embedding slot of the connection seat below the ignition device can be further installed with the safety actuating device, the difficulty of installing a safety actuating device in a housing is improved; the assembly of the safety actuating device does not require connection members such as screws, so the assembly procedure is simplified and provided with an advantage of using less components; and the housing is configured with a buckling engagement means, so the assembly is convenient.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas combustor, comprising:

a storage tank, having a gas discharge nozzle on the top of a tank body, said gas discharge nozzle being connected to one end of a gas conveying tube, and further installed with a gas discharging board;

a connection seat, having an accommodation slot at the rear, said accommodation slot in sequence accommodating and positioning a piezoelectric device of the ignition device and a pressable button member, the front of said button member being extended with a push sheet adjacent to said gas discharging board; two clamp arms at the front of said connection seat defining an insertion slot allowing an insertion tenon fixed at the rear of a mixing tube of the combustion device to be inserted and positioned, so said mixing tube being in contact with said piezoelectric device, said mixing tube being formed with at least an air inlet hole, and the front and the rear being respectively installed with an ejection nozzle connected to the other end of said gas conveying tube and a flame nozzle, an electric conduction wire of said piezoelectric device being arranged at the periphery of said flame nozzle at intervals; and a housing, composed of a left cover and a right cover being engaged, for accommodating said mentioned storage tank, said connection seat, said ignition device and said combustion device, the front and the rear openings of a control part horizontally installed on the top of said housing respectively allowing said flame nozzle and said button member to be exposed, adjacent surfaces of said housing and said connection seat being oppositely installed with positioning members, so said connected seat being fastened inside said housing;

through pressing said button member, said piezoelectric device being compressed, and said push sheet pushing said gas discharging board for lifting said gas discharge nozzle so as to supply combustion gas, so said combustion gas being conveyed by said gas conveying tube to said ejection nozzle for being ejected and mixed with air in said mixing tube, and said electric conduction wire at the lateral side of said flame nozzle generating static electric sparks for igniting the mixed combustion gas ejected from said flame nozzle.

2. The gas combustor as claimed in claim 1, wherein the bottom of said accommodation slot of said connection seat is further formed with an embedding slot for receiving a safety actuating device, and the bottom of said button member is protrudingly installed with a button protrusion; wherein said safety actuating device further includes:

a fasten member, a protrusion part at the front is directly inserted in said embedding slot for positioning, and the top of said fasten member has a chamber, the rear of said chamber is in communication with a guide slot longitudinally installed, and the left and the right sides at the front are formed with a pair of rail slots, wherein the horizontal bottom wall at the front of said chamber is concavely formed with a concave slot in which a horizontal resilient member is installed, and the vertical bottom wall at the rear of said chamber is installed with a vertical resilient member;

a press member, the rear thereof is longitudinally installed with a press piece exposed outside the rear opening of said housing, a neck part at the front of said press piece is inserted in said guide slot, and the front of said neck part is longitudinally and protrudingly installed with a block abutted against said button protrusion at the bottom of said button member, the left and the right sides of said block are oppositely and protrudingly formed with a pair of engaging tenons, and the notch of each engaging tenon forms an engaging slot; and a slide member, slide rails at the left and the right sides thereof are inserted into the pair of rail slots, the bottom of said slide member is protrudingly installed with a push tenon which incorporates with said concave slot to hold said horizontal resilient member, the left and the right sides at the rear of said slide member are protrudingly installed with a pair of joint tenons, a tenon slot is formed between said two joint tenons for accommodating said block;

through downwardly pulling said press piece, said block is synchronously descended, and said joint tenons of said slide member are no longer provided with the support of said engaging slots of said engaging tenons thereby being backwardly moved, such that said joint tenons are jointed at the top of said engaging tenons; when said button member is pressed, said button protrusion passes through said tenon slot, and the bottom edge of said button member pushes said joint tenons, such that said press member is upwardly moved but still be abutted by the bottom of said button member; when said button member is released, said slide member and said press member form an automatic latch locking state through the recovery of said button member.

3. The gas combustor as claimed in claim 2, wherein said vertical bottom wall at the rear of said chamber is formed with a concave hole, the bottom of said block is formed with an engaging hole, and one end of said vertical resilient member is inserted in said concave hole and the other end is inserted in said engaging hole.

4. The gas combustor as claimed in claim 1, wherein the lower portion of said tank body is installed with at least an elongated viewing window, and a vertical handgrip part of said housing is installed with a window opening corresponding to the location of said viewing window.

5. The gas combustor as claimed in claim 1, wherein opposite inner walls of said button member and said accommodation slot are installed with at least a recovery resilient member.

6. The gas combustor as claimed in claim 1, wherein the left and the right sides of said accommodation slot and said button member are oppositely installed with elongated slide rails and block-shaped slide tenons, the pair of slide tenons are installed in said slide rails in a slidable fashion.

7. The gas combustor as claimed in claim 1, wherein adjacent surfaces of said housing and said storage tank are oppositely installed with a positioning rib and a positioning slot capable of being mutually engaged.

8. The gas combustor as claimed in claim 1, wherein engaging surfaces of said left cover and said right cover are oppositely installed with plural pairs of buckling hooks and buckling slots capable of being mutually buckled.

9. The gas combustor as claimed in claim 1, wherein said flame nozzle is provided with a heat insulation member made of a ceramic material, and installed at the front of said mixing tube, the exterior of said heat insulation member is installed with an outer shell made of a metal material, and said electric conduction wire of said piezoelectric device passes through said outer shell and said heat insulation member and is arranged at the periphery of said flame nozzle at intervals.

10. The gas combustor as claimed in claim 1, wherein further comprising a gas regulation ring installed on said gas discharge nozzle, and a regulation rod laterally extended from said gas regulation ring protrudes out of an elongated cover slot preset on said housing.

11. The gas combustor as claimed in claim 1, wherein further comprising a continuous gas supply switch installed in a housing slot, the front and the rear of said switch are protrudingly installed with at least a pair of slide hooks buckled in said housing slot, and a buckling rod is protruded between said two slide hooks; the front of said button member is extended with a buckling sheet toward said continuous gas supply switch; when said button member is in the pressed state, said continuous gas supply switch is upwardly pulled, such that said buckling rod is buckled with said buckling sheet, and said button member is not able to backwardly move for recovery, and said push sheet continuously abuts said gas discharging board, for forming a continuous gas supply state.

12. A safety actuating device used in a gas combustor, comprising:

a fasten member, having a chamber at the top, the rear of said chamber being in communication with a guide slot longitudinally installed, and the left and the right sides at the front being formed with a pair of rail slots, wherein the horizontal bottom wall at the front of said chamber being concavely formed with a concave slot in which a horizontal resilient member being installed, and the vertical bottom wall at the rear of said chamber being installed with a vertical resilient member;

a press member, the rear thereof being longitudinally installed with a press piece, a neck part at the front of said press piece being inserted in said guide slot, and the front of said neck part being longitudinally and protrudingly installed with a block, the left and the right sides of said block being oppositely and protrudingly formed with a pair of engaging tenons, and the notch of each engaging tenon forming an engaging slot; and a slide member, slide rails at the left and the right sides thereof being inserted into the pair of rail slots, the bottom of said slide member being protrudingly installed with a push tenon incorporating with said concave slot to hold said horizontal resilient member, the left and the right sides at the rear of said slide member being protrudingly installed with a pair of joint tenons, a tenon slot being formed between said two joint tenons for accommodating said block;

through downwardly pulling said press piece, said block being synchronously descended, and said joint tenons of said slide member being no longer provided with the support of said engaging slots of said engaging tenons thereby being backwardly moved, such that said joint tenons being jointed at the top of said engaging tenons; when said joint tenons being pushed forward by an external force, said press member being upwardly moved, and said engaging slots being engaged with the bottom of said joint tenons, such that said slide member and said press member forming an automatic latch locking state.

13. The safety actuating device used in the gas combustor as claimed in claim 12, said vertical bottom wall at the rear of said chamber is formed with a concave hole, the bottom of said block is formed with an engaging hole, and one end of said vertical resilient member is inserted in said concave hole and the other end is inserted in said engaging hole.

* * * * *